United States Patent [19]

Aschwanden et al.

[11] Patent Number: 5,058,224

[45] Date of Patent: Oct. 22, 1991

[54] UNDERMATTRESS LATHS HAVING SPRING TYPE CONNECTIONS

[75] Inventors: Franz Aschwanden; M. Eberhart, both of Gersau, Switzerland

[73] Assignee: HCM AG, Switzerland

[21] Appl. No.: 392,860

[22] Filed: Aug. 11, 1989

[30] Foreign Application Priority Data

Aug. 12, 1988 [DE] Fed. Rep. of Germany ..... 3827476

[51] Int. Cl.[5] ..... A47C 23/06; A47C 23/30

[52] U.S. Cl. ..... 5/238; 5/236.1; 5/241

[58] Field of Search ..... 5/236.1, 238, 239, 241, 5/245, 446, 447

[56] References Cited

U.S. PATENT DOCUMENTS

| | | | |
|---|---|---|---|
| 53,853 | 4/1866 | Metz | 5/241 |
| 54,292 | 5/1866 | Canfield | 5/241 |
| 76,674 | 4/1868 | Tambling | 5/241 |
| 95,945 | 10/1869 | Smith | 5/241 |
| 121,647 | 12/1871 | McMaster | 5/241 |
| 124,032 | 2/1872 | Brownlee | 5/241 |
| 2,491,557 | 12/1949 | Goolsbee | 5/236 |
| 2,638,606 | 5/1953 | Austin | 5/239 |

FOREIGN PATENT DOCUMENTS

| | | | |
|---|---|---|---|
| 38155 | 10/1981 | European Pat. Off. | 5/238 |
| 38516 | 6/1965 | Fed. Rep. of Germany . | |
| 520920 | 2/1921 | France | 5/239 |
| 526164 | 6/1921 | France | 5/239 |
| 8502987 | 7/1985 | PCT Int'l Appl. . | |

*Primary Examiner*—Gary L. Smith
*Assistant Examiner*—F. Saether
*Attorney, Agent, or Firm*—Sixbey, Friedman, Leedom & Ferguson

[57] ABSTRACT

An undermattress which includes a frame which is spanned in a transverse direction by a plurality of laths which are supported on the frame at each end, so as to be yieldable in a direction of loading of the undermattress, by structure that holds a plurality of laths via joints (3,4,7) which are each formed from a joint pin (3) having a spherical or ellipsoidal joint head (4) and a guide bush (7). Each joint head (4) is fitted into a respective guide bush (7) and is shaped for enabling movement of the joint pin (3) relative to the guide bush (3) in every direction. In this way, sufficient freedom of movement is provided to enable the laths to be held without tilting on the frame even under unilateral loading.

26 Claims, 21 Drawing Sheets

UNDERMATTRESS LATHS HAVING SPRING TYPE CONNECTIONS

BACKGROUND OF THE INVENTION

The invention relates to an undermattress of the type having a frame which is spanned in a transverse direction by a plurality of laths which are supported on the frame at each end by a respective joint and by a yieldable means for supporting said laths in conjunction with said joints, so as to be yieldable in a direction of loading of the undermattress.

In such an undermattress known from Swiss Patent 388,516 the yieldable means consists of resiliently yieldable support elements on which the laths or battens, which as a rule would be arched in the unloaded state, are supported at both ends, said support elements each being formed by a rubber element which has approximately the form of a triangle with upwardly pointing tip. The corner regions at the base line of this triangular rubber element are provided with bores via which each of said elements is fitted onto two pins anchored on the frame. In the region of the tip the rubber elements have two notches into which the forked ends of the laths engage.

WO 85/02 987 discloses a further undermattress according to the preamble of claim 1 in which the yieldable means consists of an elastic rope which runs over pulleys, the lath ends being tiltably connected to push members of which the other ends carry further pulleys with which the push members bear on the rope led over said first pulleys in guides in the frame of the undermattress.

In this known arrangement a so-called composite effect is achieved in so far as the loading at one point of the rope by a lath of the undermattress influences the rope tension at other points. Thus, in this known undermattress no individual suspension of the laths is provided but on compression of the push members connected to the laths at the rope the tension and thus the spring constant of the rope for the push members of other adjacent laths are influenced in such a manner that said spring constant increases.

In the aforementioned known undermattress the laths are mounted via pins pivotally movable in the longitudinal direction of the frame on the push members so that their angular position to the horizontal direction can adapt itself to the lying of for example a human body on the overmattress disposed above the undermattress.

The known undermattress has however the disadvantage that because the laths mounted at both ends partially on pins or bores due to one-sided body loading are not always horizontally loaded diagonal displacements occur and this results in a transverse positioning of the laths and thus a change of length in the horizontal direction and because there is no length compensation a high frictional engagement can occur between the push members and the frame which can be so pronounced that the push members jam and can no longer fulfill their function.

SUMMARY OF THE INVENTION

Compared with the noted known undermattress, the problem underlying the invention resides in further developing an undermattress of the type described initially above, in such a manner that a diagonal length compensation can take place under one-sided loading of the laths and thus a tilting of the laths on the frame can be avoided.

This problem is solved according to preferred embodiments of the invention.

Due to the fact that in the undermattress according to the invention the lath ends are supported via the joints indicated on the yieldable means, said joint connection provides the freedom of movement necessary for holding the laths without tilting on the frame even under unilateral loading.

Particularly preferred further developments and embodiments of the undermattress according to the invention are the subject of claims 2 to 26.

Hereinafter particularly preferred examples of embodiment of the invention will be described in detail with the aid of the associated drawings.

DETAILED DESCRIPTION OF THE PREFERRED EMBODIMENTS

Figure 1A:
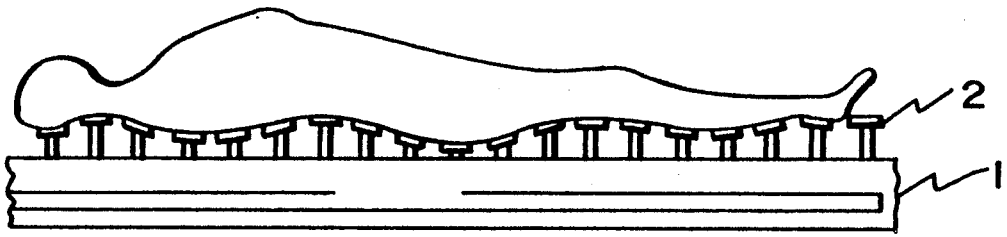
FIGS. 1A and 1B show in side elevation the supporting of a human body by the laths of an undermattress.
Figure 1B:
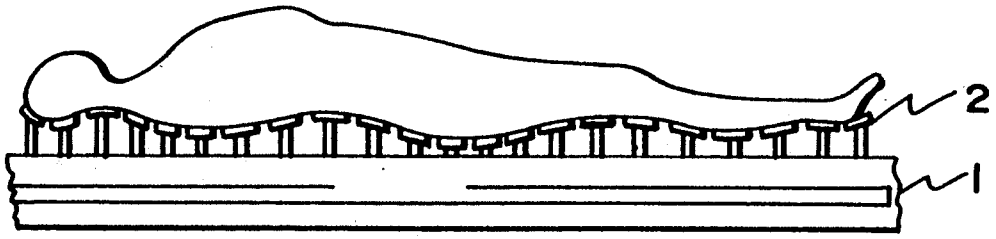

FIGS. 1A and 1B show in side elevation a human body lying on an undermattress with transversely extending battens or laths and as can be seen from the illustrations of FIGS. 1A and 1B, both the height and the inclination angle to the horizontal of the laths should be adapted to the body profile and the weight distribution in the longitudinal direction of the body to obtain as complete as possible a load and counterload equalization and thus complete adaptation to the body.

To ensure this adaptation the laths 2 must be held on the frame also as to be both adjustable in their height and adaptable in their inclination angle to the human body.

Figure 2:
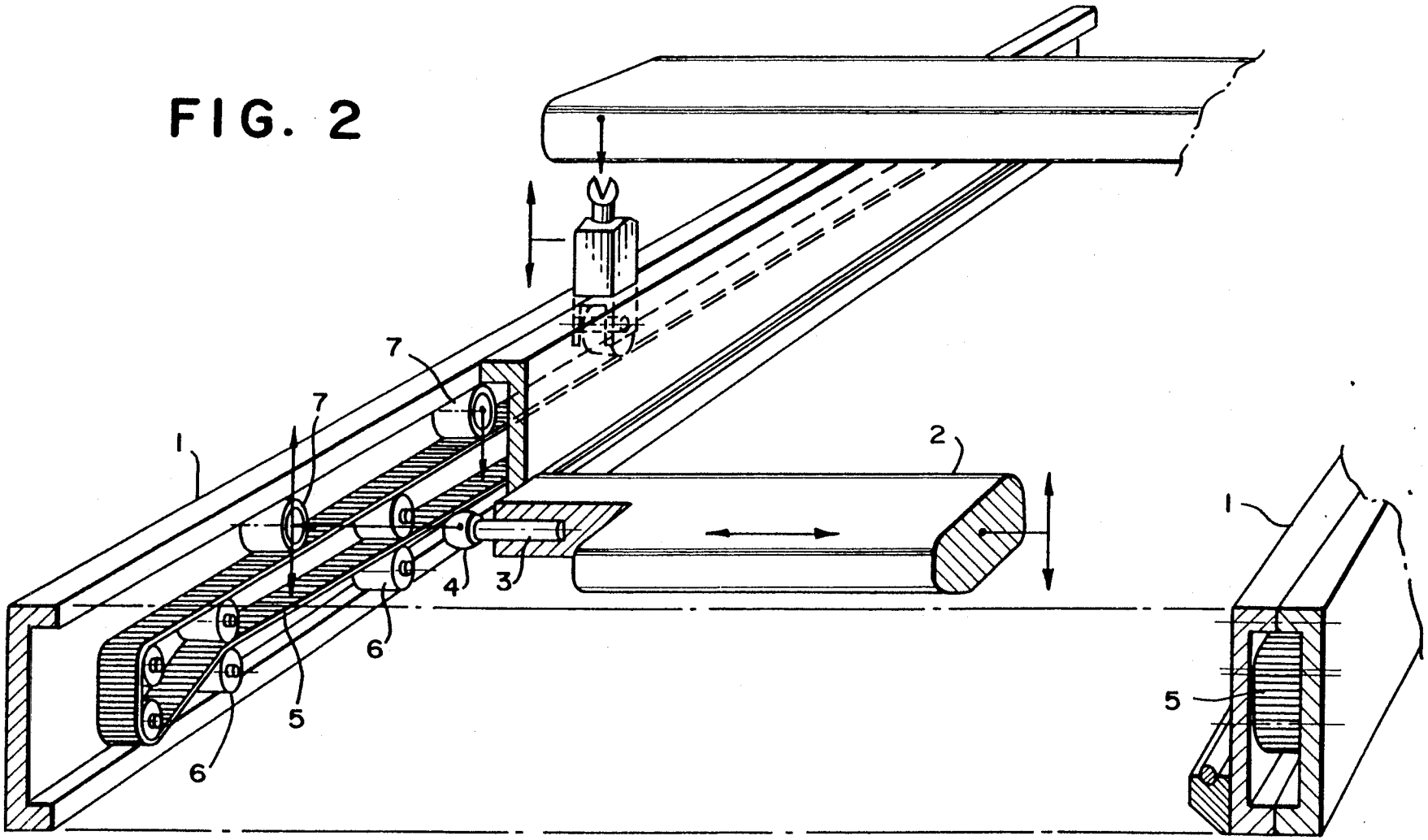
FIG. 2 shows in a perspective fragmentary view a first example of embodiment of the invention.

FIG. 2 shows a first preferred example of embodiment of the undermattress according to the invention comprising a frame 1 in which an elastic preferably endless band 5 is guided respectively over rollers 6. The two runs or webs of the band 5 extend in the longitudinal direction of the frame 1 whilst in the transverse direction the laths 2 are arranged which are supported in the manner illustrated via a joint connection on the elastic band 5. The joint connection includes a joint pin 3 at the end of the laths 2 which has a spherical or ellipsoidal joint head 4 which is fitted into a guide bush 7 which has an internal diameter corresponding with light clearance to the external diameter of the joint head 4. The guide bush 7 lies directly on the elastic band 5 between preferably two roller pairs 6 so that the applied weight bearing on a lath 2 is transmitted via the joint connection to the elastic band 5. The resulting sagging of the band 5 tensions the latter at other points so that it is tighter there and has a different spring constant and this leads to a tighter engagement of the guide bush 7 of an adjacent lath 2. This results in a sort of composite system in which the load acting on a lath 2 is transmitted via the band 5 to different points of the undermattress in such a manner that the elasticity of the band 5 obtaining there is influenced in the sense of a higher spring constant.

The formation of the joint connection in the form of a joint pin 3 with a spherical or ellipsoidal head 4 in a guide bush 7, preferably formed as hollow cylindrical element, gives a movement clearance of the laths 2 in every direction so that tilt and pivot movements and unilateral loads at the edge of the frame which might lead to inclination of the laths 2 in the transverse direction and thus to a shortening in the horizontal direction can be taken up.

Figure 3B:
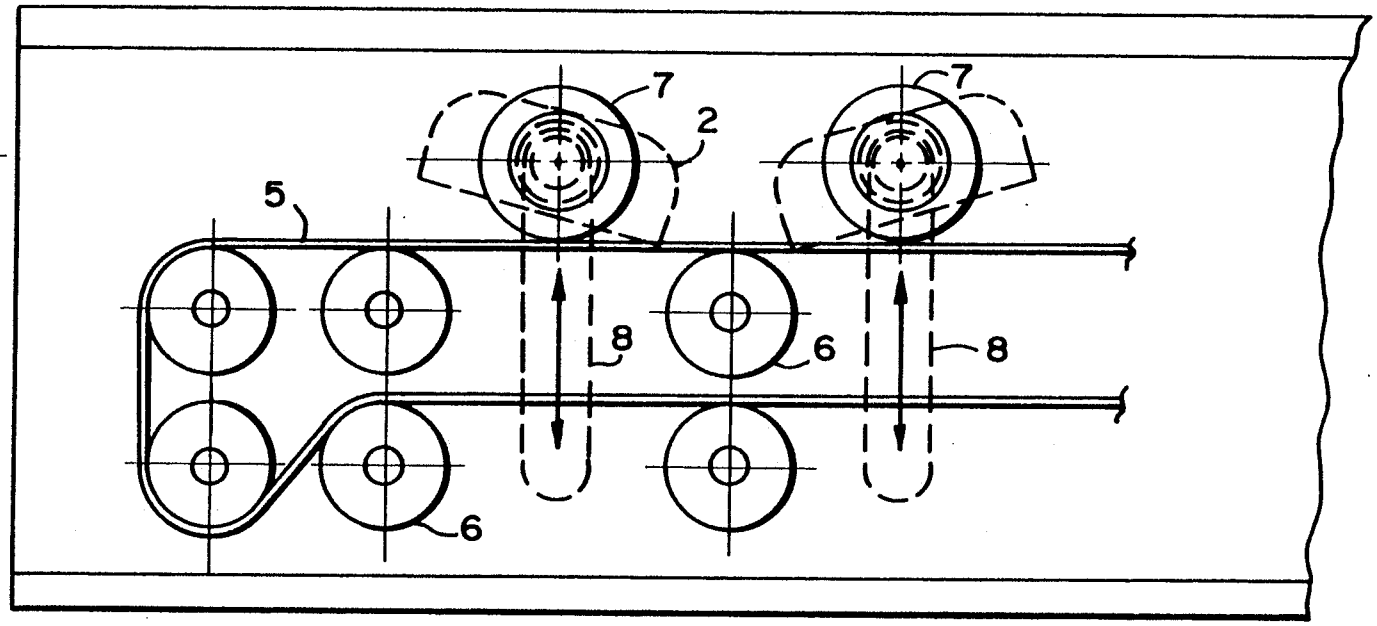
FIGS. 3A and 3B are a sectional view and a side elevation of the first example of embodiment of the invention.
Figure 3A:
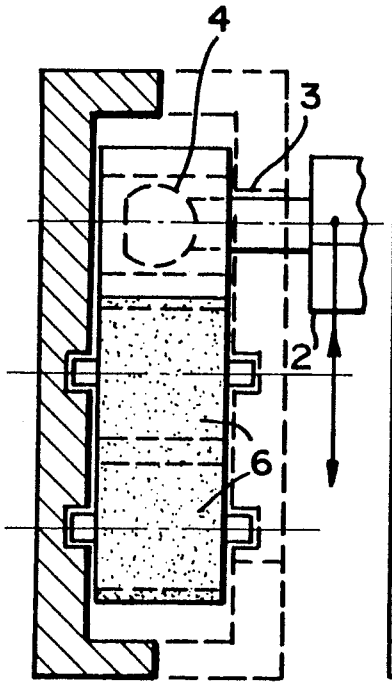
Figure 4B:
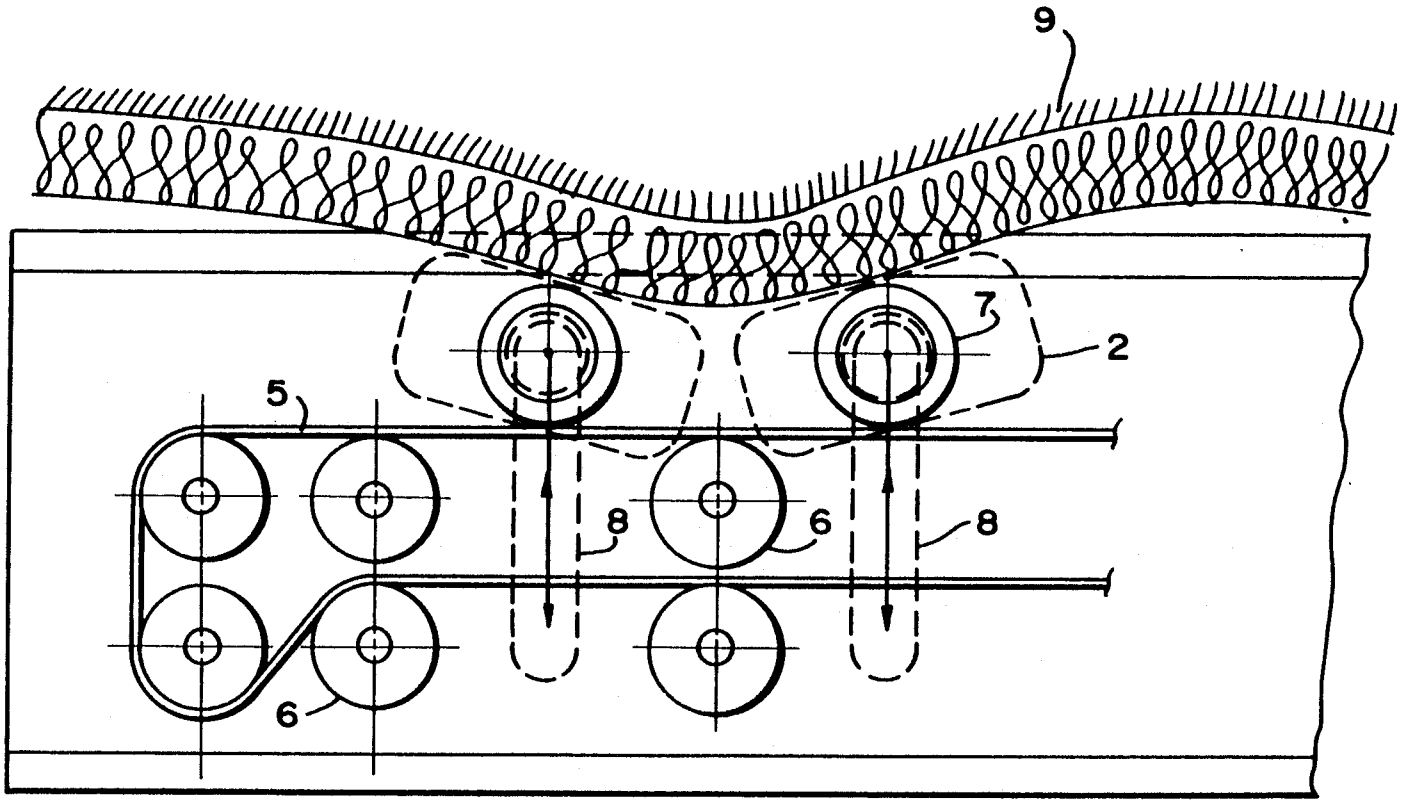
FIGS. 4A and 4B are a sectional view and a side elevation of a further example of embodiment of the invention.
Figure 4A:
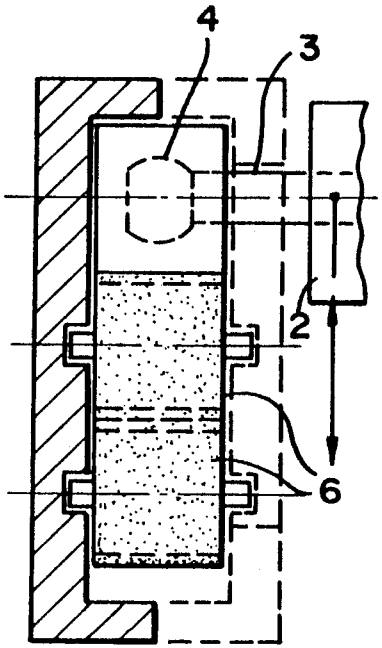

As illustrated in particular in FIGS. 3A and 3B, the frame 1 is made from two parts, guide slots 8 being provided in the part facing the laths and in said slots the guide pins 3 are guided for vertical movement FIGS. 4A and 4B show an example of embodiment which is adapted to te arranged directly beneath an upper mattress For this purpose the laths 2 have a height which is at least equal to the external diameter of the guide bush 7 so that the upper mattress 9 can be supported over the full width of the laths 2. In this construction the frame of the undermattress may consist directly of the side members of a bed.

Figure 5B:
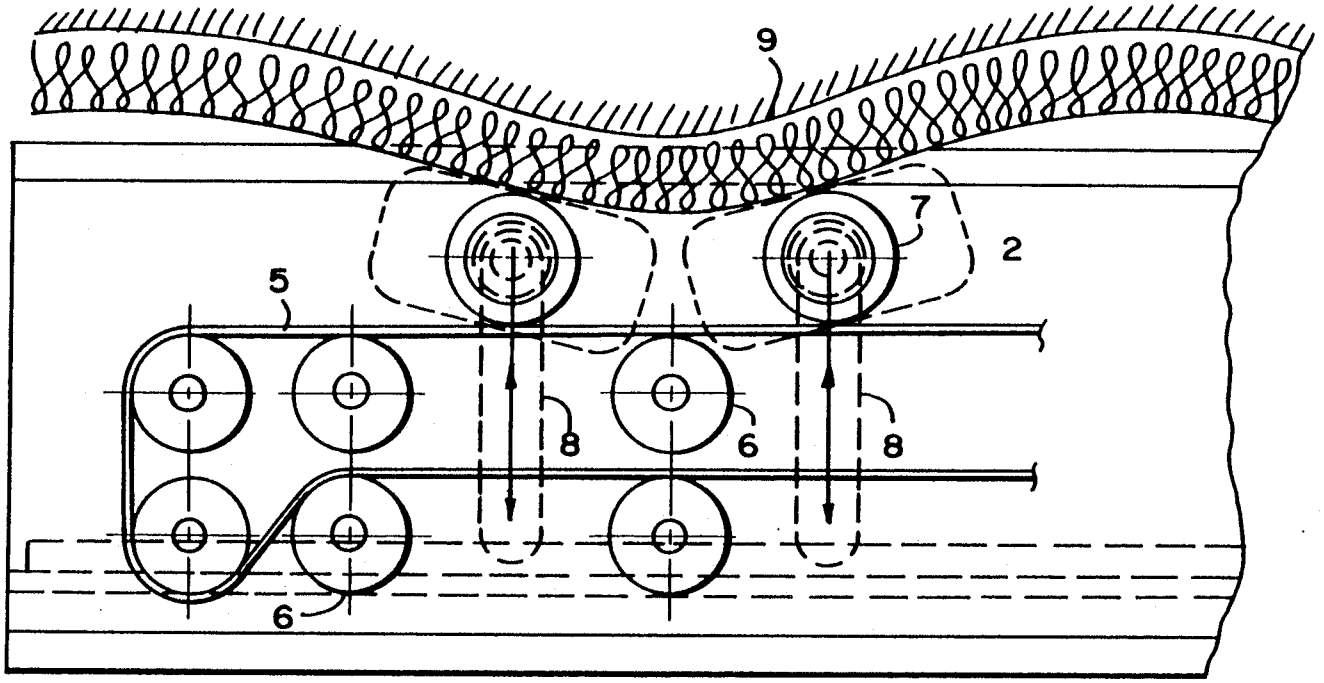
FIGS. 5A–5C are sectional, side elevational and perspective views of a further development of the example of embodiment illustrated in FIG. 4.
Figure 5A:
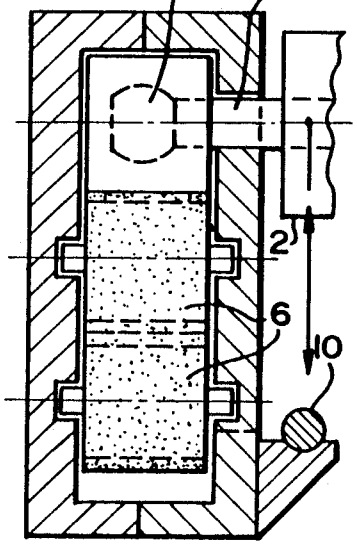
Figure 5C:
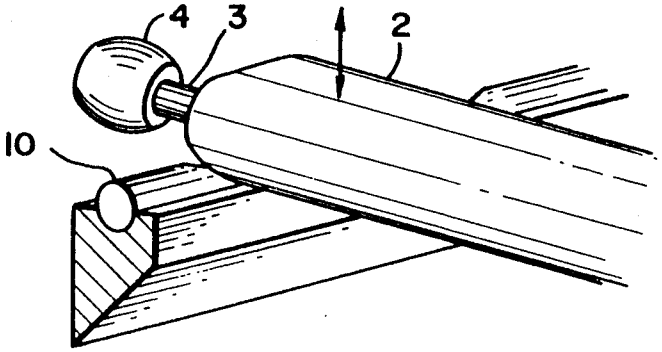

FIGS. 5A and 5B show the example of embodiment illustrated in FIGS. 4A and 4B in a modified form in which in addition a stop rod or a stop bar 10 is provided at the lower part of the frame on which the laths 2 when completely depressed, i.e. when reaching their lowermost position, come to bear. The rod 10 limits the downward vertical movement of the laths 2.

Figure 6:
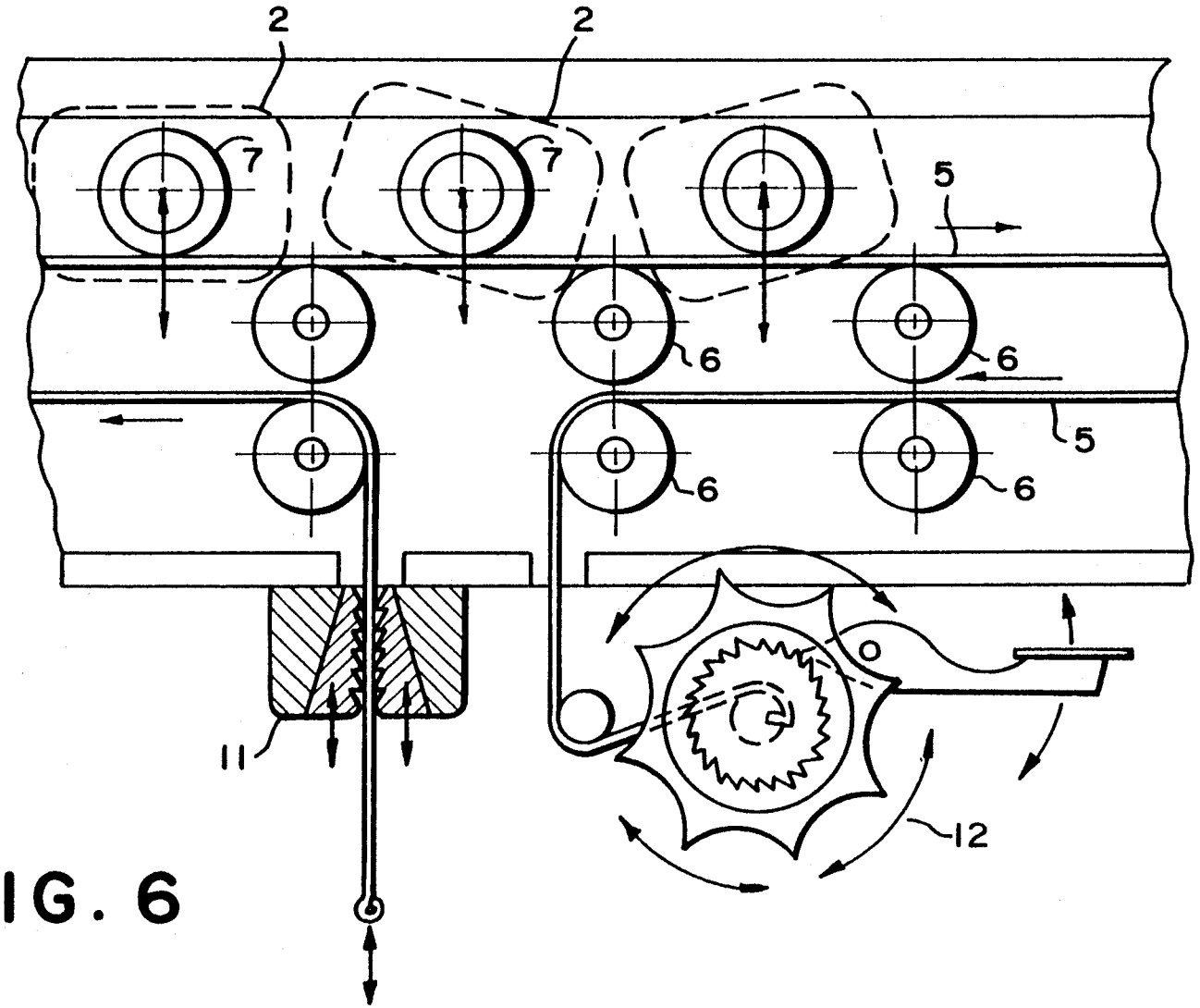
FIG. 6 shows an example of embodiment of a withdrawing and arresting means for an example of embodiment of the invention.

As shown in FIG. 6 the band 5 need not be endless; in this case one end of the band is attached to a ratchet or pawl means 12 from which it can be withdrawn at the other end, said other end leading through a holding or locking means 11 which is provided in a manner known per se with an internal engagement toothing in such a manner that the band can be withdrawn from the pawl means 12 through the holding element 11 and fixedly held in the latter so that in this manner the band tension is variable. By releasing the locking of the pawl means 12 or the holding means 11 it is also possible to change the band tension in the sense of reducing the latter.

In the first example of embodiment of the invention described above the lath ends were supported directly via the joint connection on the band 5. In the example of embodiment illustrated in FIGS. 7A and 7B, the lath ends are provided via the joint connection with rams or push members 13 which can slide in guides 14 in the frame 1 and bear with their lower end on the band 5. The formation of the band 5 and its guiding via rollers 6 are otherwise identical to the corresponding constructions in the first example of embodiment Thus, in this second example of embodiment a joint connection is also provided which comprises a joint pin 3 with joint head 4 on the one hand at the end of the laths 2 and a guide bush 7 at the end of the push members 13 opposite the band 5. The arrangement of the push members 13 makes it superfluous to provide a guide slot 8 in the frame 1 in which the joint pin 3 is vertically guided, as was the case in the first example of embodiment.

Figure 7A:
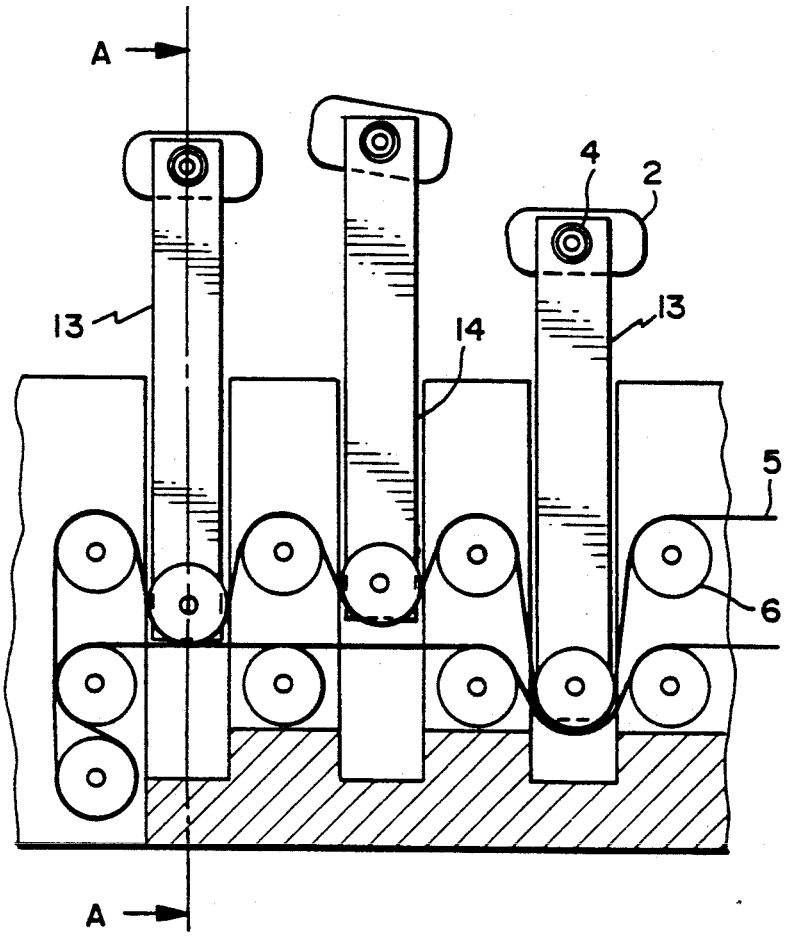
FIGS. 7A and 7B show side elevation and cross sectional views a further example of embodiment of the invention.
Figure 7B:
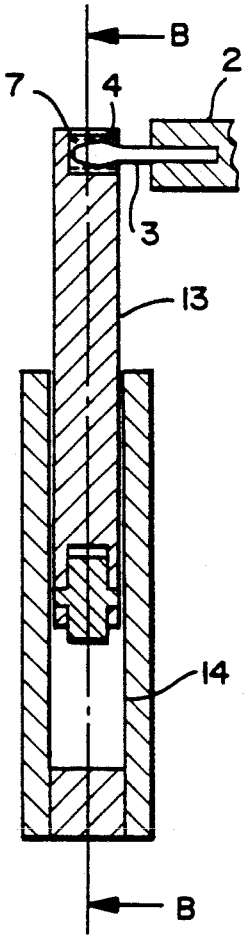
Figure 8B:
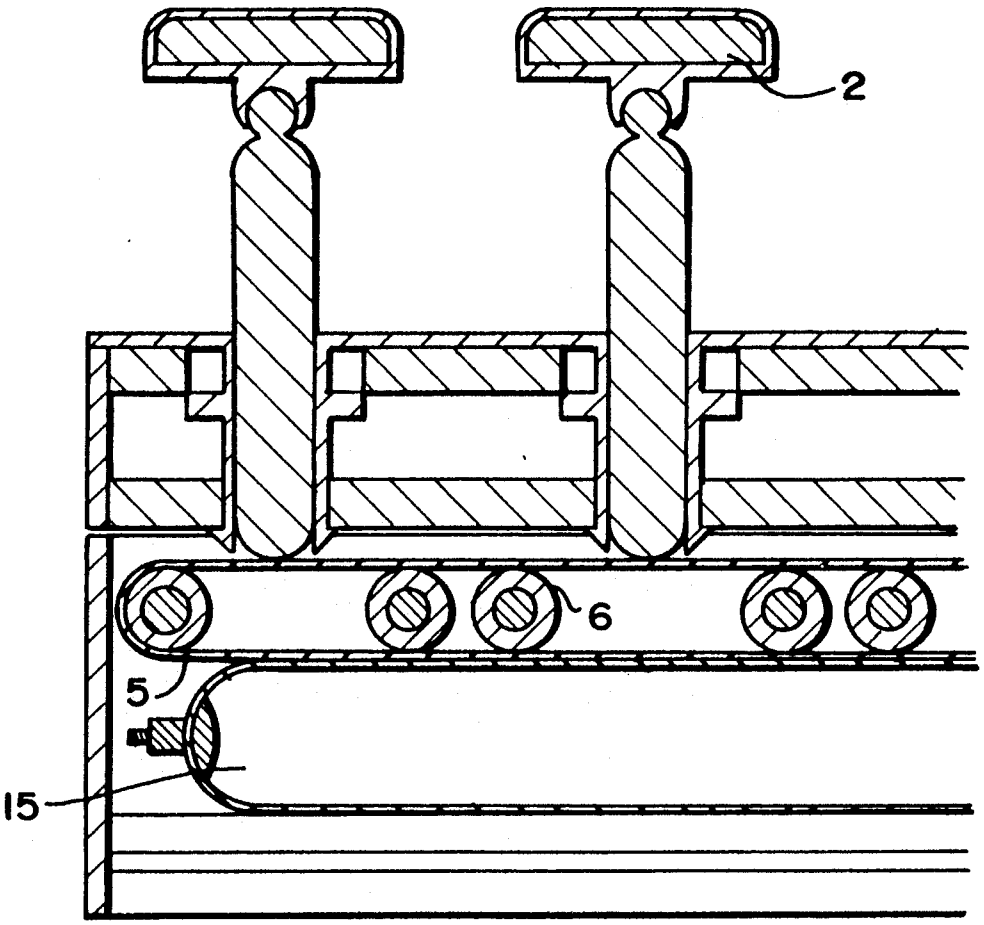
FIGS. 8A and 8B are sectional views of the supporting of the lower web or run of the elastic band in an example of embodiment of the invention.
Figure 8A:
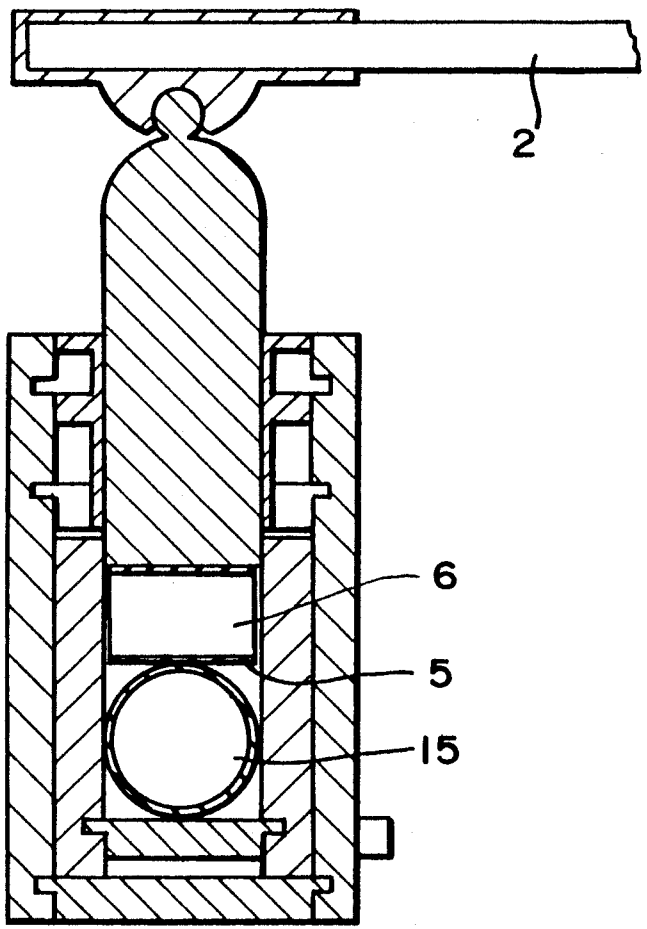

FIGS. 8A and 8B show a further development of the example of embodiment illustrated in FIGS. 7A and 7B in such a manner that the band 5 is made endless and runs over rollers 6, the run of the band 5 opposite the resting or support points of the laths 2 running on a flexible tube or hose 15 of an elastic material which is inflatable or expandable and is filled with air and/or water or a similar medium under variable pressure. Via the hose or flexible tube 15 it is possible to preset and adjust a basic tension of the band 5 with respect to the load by the laths 2 supported on the band 5. That is, as should be recognized to be the case, by increasing or decreasing the internal pressure of elastic tube or hose 15, it will expand or contract, thereby increasing or decreasing the prestressing pressure applied by it to band 5.

Figure 9B:
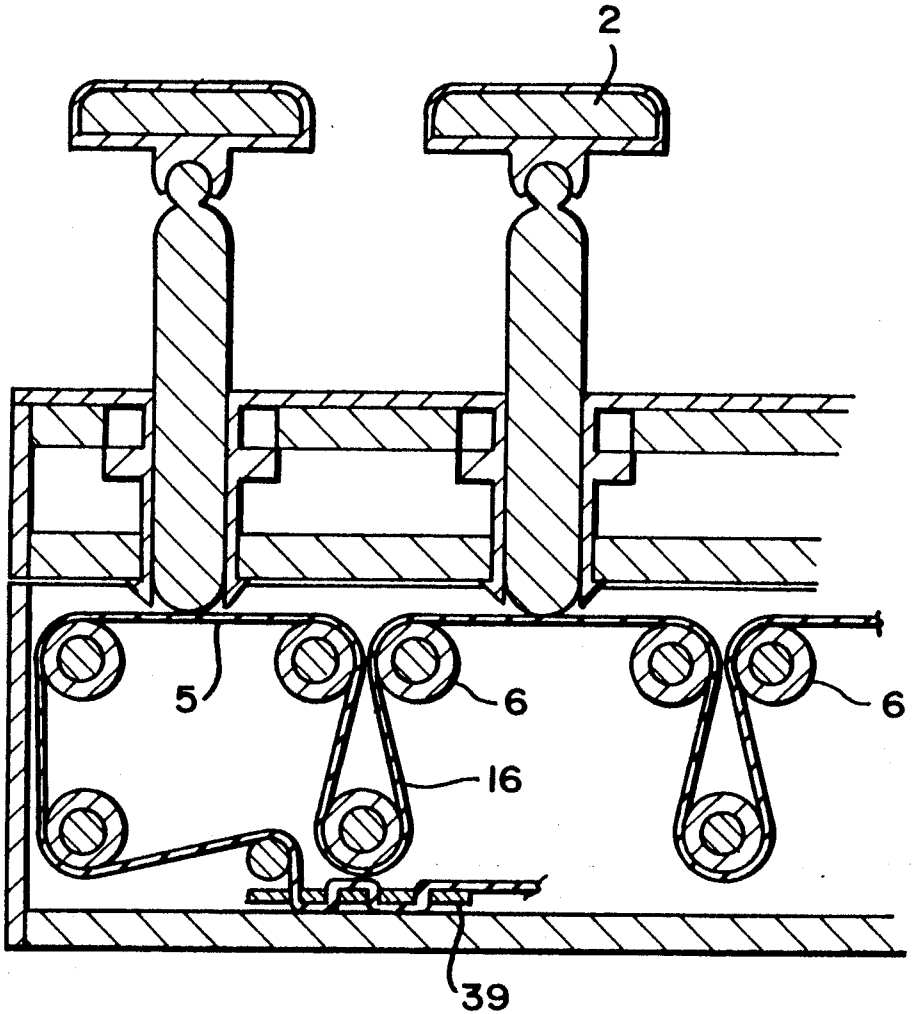
FIGS. 9A and 9B are sectional views of the web guide.
Figure 9A:
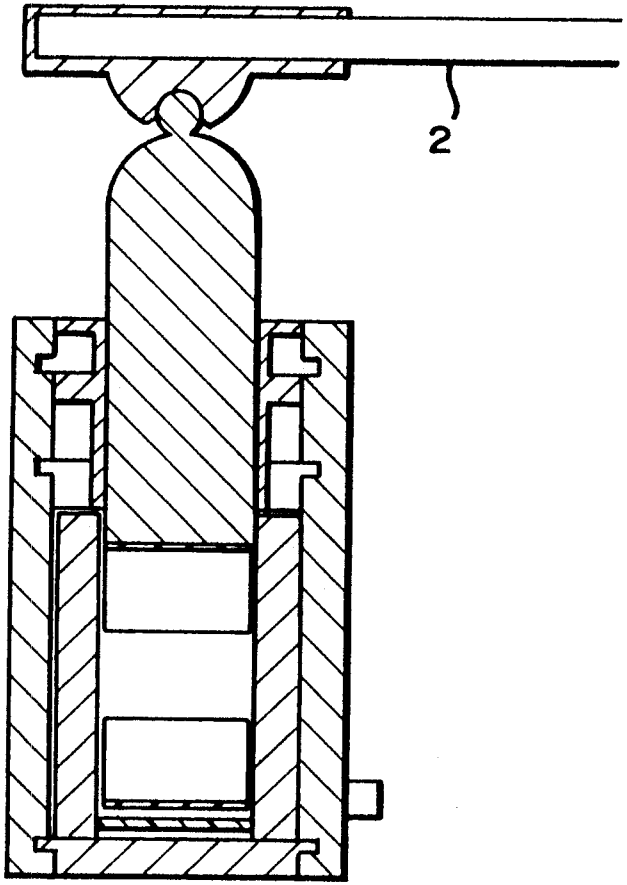

As illustrated in FIGS. 9A and 9B, the band 5 may be guided in such a manner that it is led between to support points of the laths 2 round a further roller in the form of a loop 16, one end of the band being detachably and tightenably anchored to a buckle 39, i.e. adjustable in its tension.

Figure 10B:
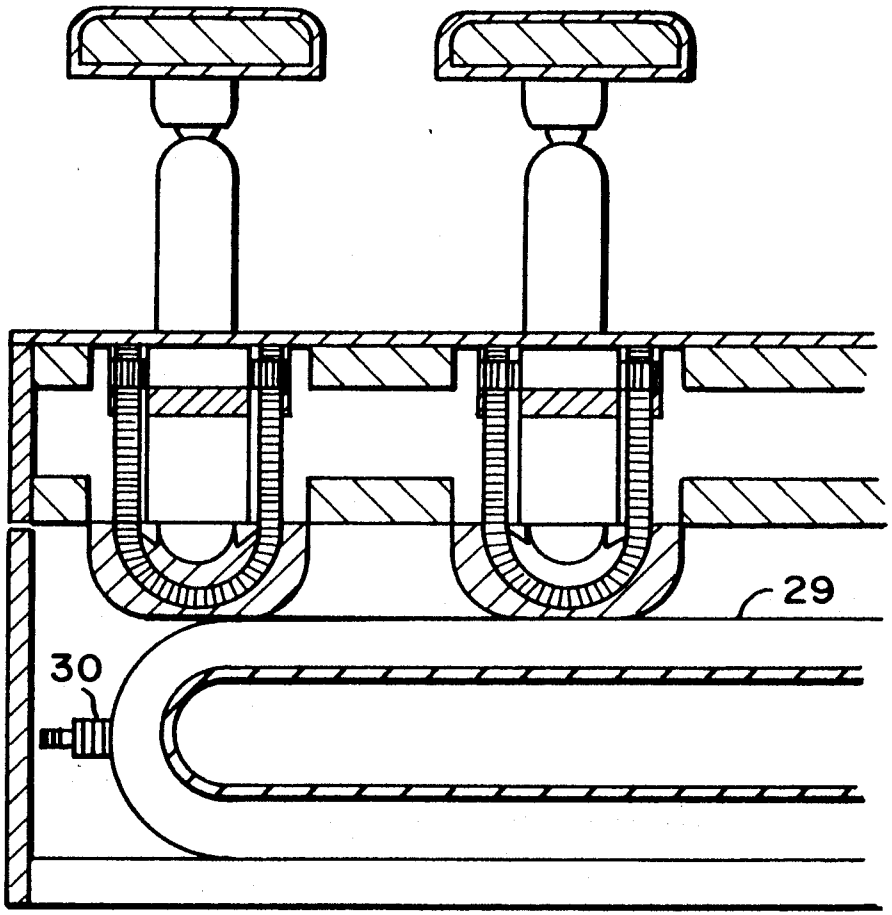
FIGS. 10A and 10B are sectional views of another example of embodiment of the invention.
Figure 10A:
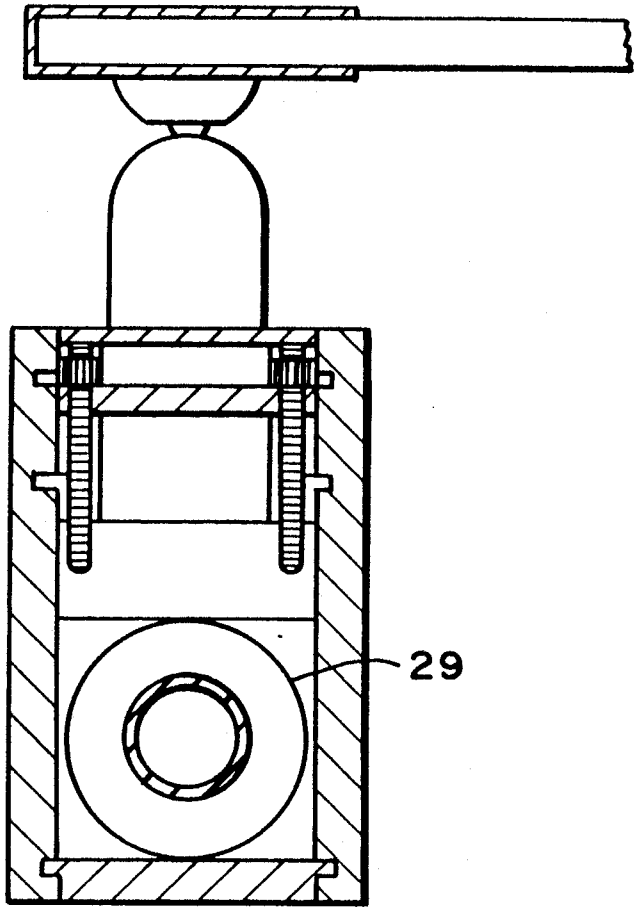

In the example of embodiment illustrated in FIGS. 10A and 10B a hose 29 filled with a pressure transfer medium is disposed beneath the push members arranged at the lath ends and is provided with a nipple 30 for pressure equalization. By means of an electromechanically actuable cylinder not shown the pressure can be set to the particular body weight which is exerted via the laths and the push members connected thereto onto the hose 29.

Figures 11A, 11B:
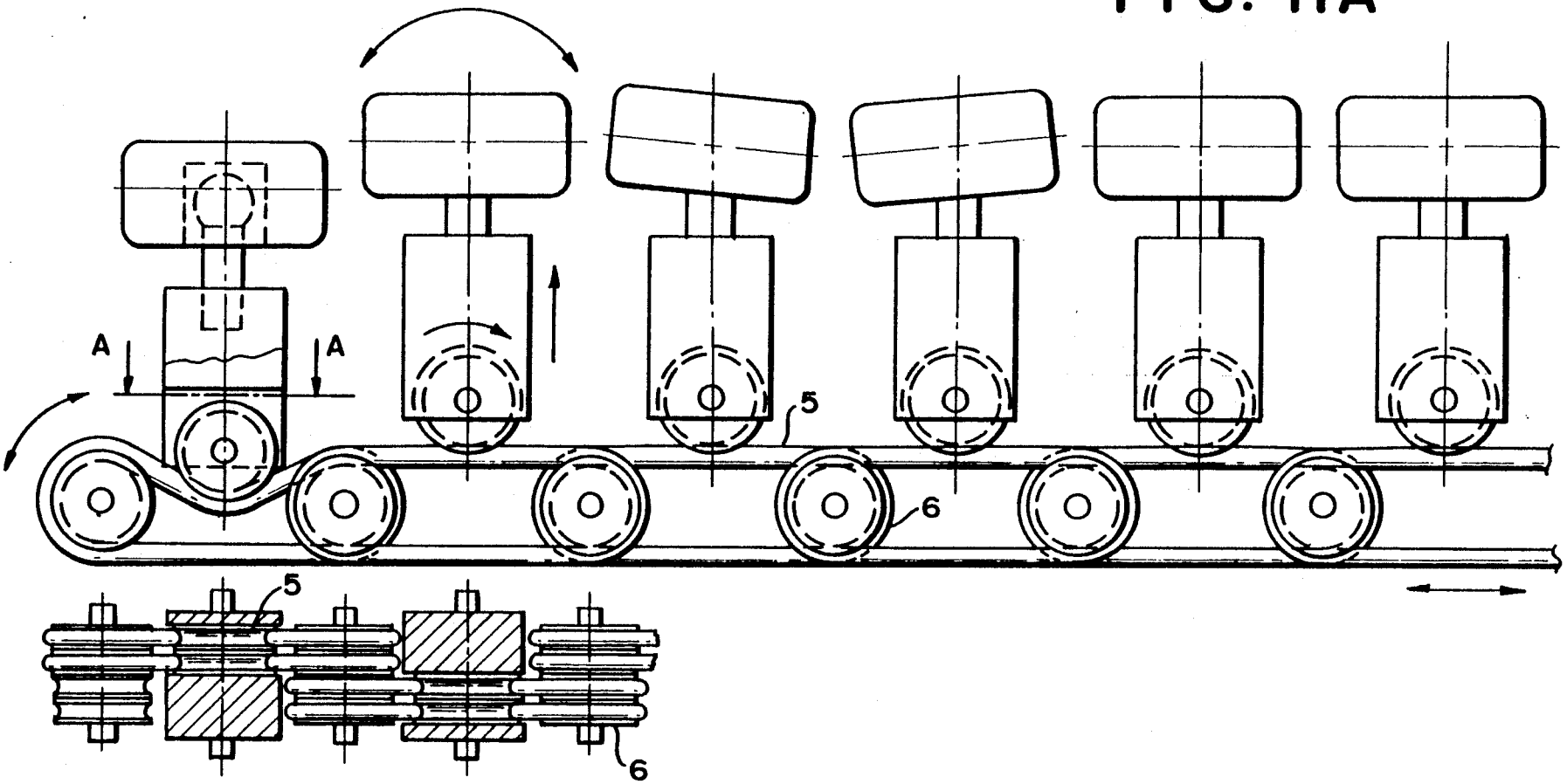
FIGS. 11A and 11B show side elevation and sectional view of a further example of embodiment of the invention.

FIGS. 11A and 11B show an example of embodiment of the invention in which the rollers 6 are multiply fluted and surrounded with rubber-like bands 5 or hoses. The undermattress in this embodiment may be pretensioned with weight compensation into one to three individual sections and at the points at which more weight is applied two to four surroundings may be used whilst at the points at which less weight is applied, corresponding for example to the shoulder and head regions, only one surrounding is provided. In the feet and pelvis region two roller bracings might be necessary.

Figure 12B:
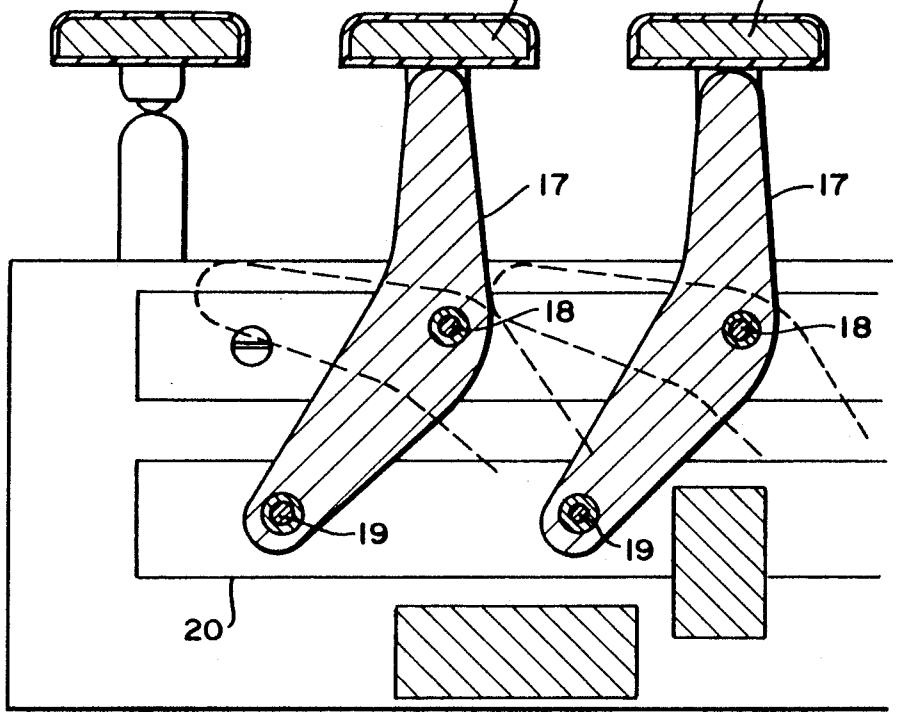
FIGS. 12A–12C show a further example of embodiment of the invention.
Figure 12A:
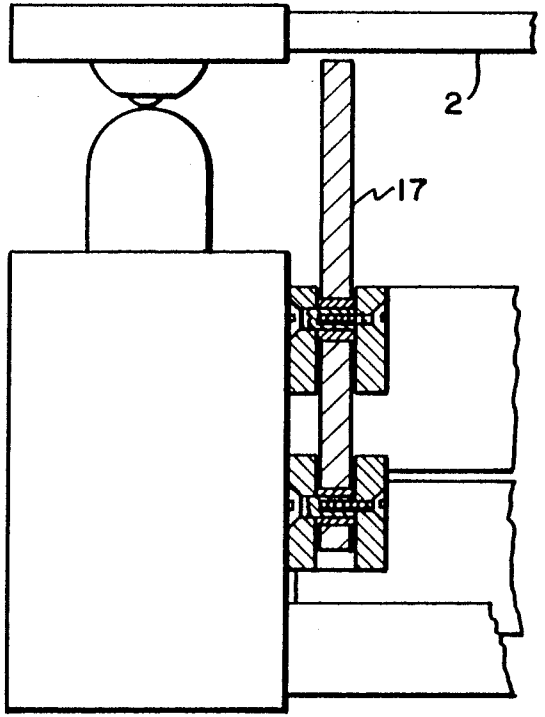
Figure 12C:
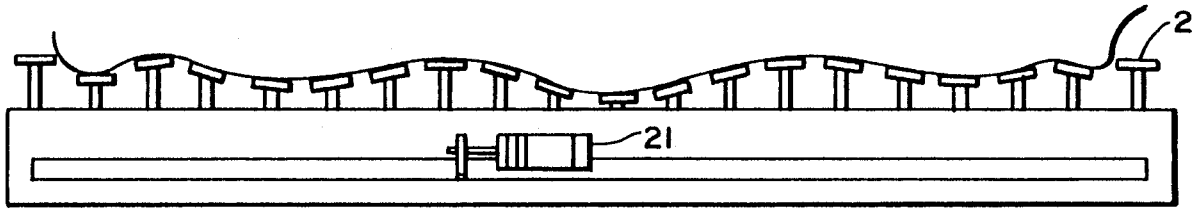

In the example of embodiment of the invention illustrated in FIGS. 12A–12C angle levers 17 are provided which are pivoted in their centre about a pin 18 which projects at the inner wall of the frame 1. The lower end of each angle lever 17 is articulately connected via a further pin 19 to a thrust rod 20 which is displaceable longitudinally of the frame. The angle levers 17 are arranged in such a manner that in one position of the thrust rod 20, which is illustrated in FIG. 12B by a full line, the laths 2 are supported by the end of the angle lever 17 opposite the pivot pin 19 so that a spring movement at the elastic means, i.e. the band 5 arranged in the frame 5, is blocked In this position the laths 2 cannot resiliently move. By displacing the thrust rod 20 the angle levers 17 can be pivoted into the position which is illustrated by dash lines in FIG. 12B and in which the laths 2 are again freely supported on the band 5 so that they can execute a spring movement The thrust rod 20 may be moved via a means 21 selectively into its blocking position or release position.

Figure 13B:
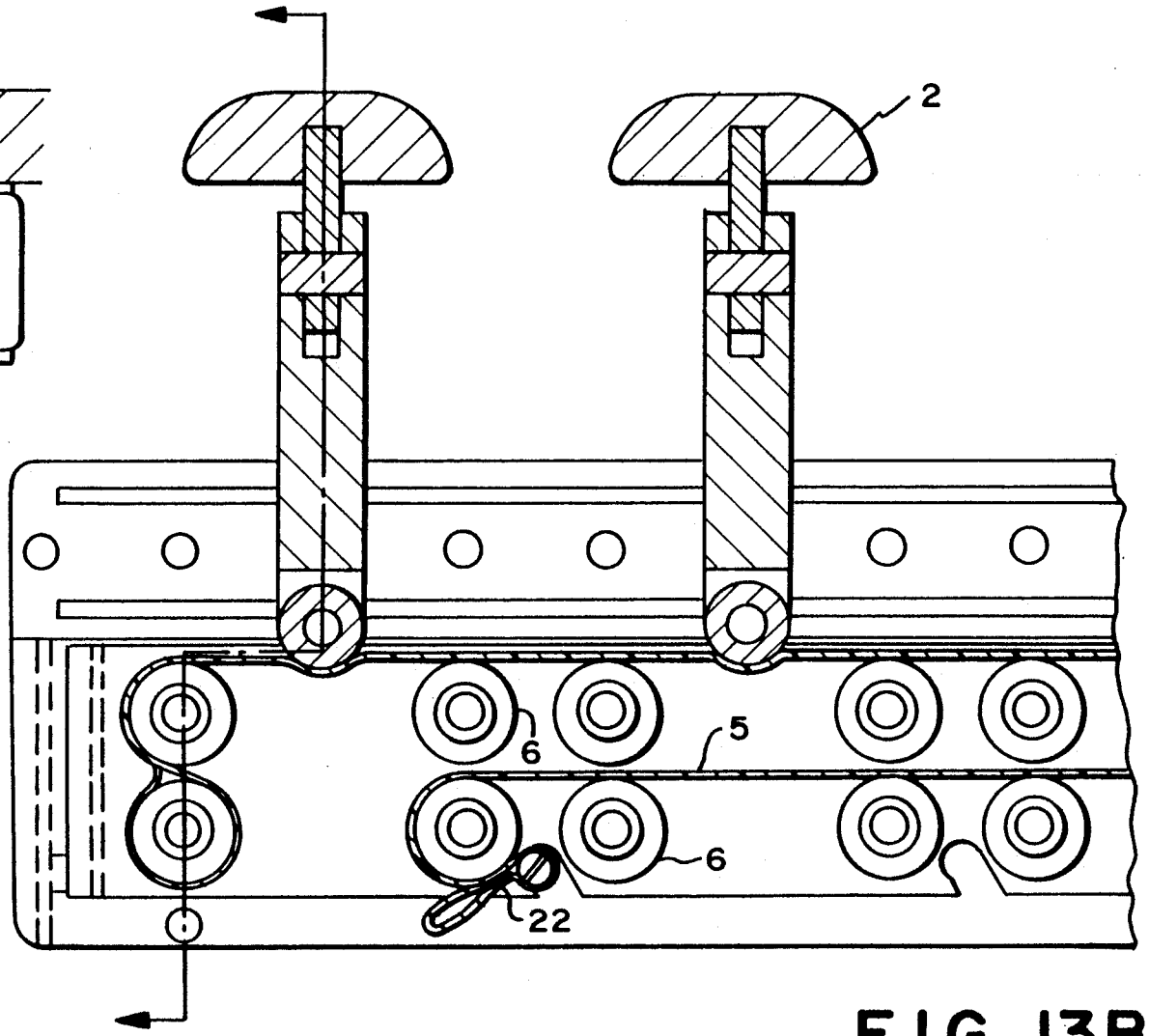
FIGS. 13A and 13B show a tensioning means for the band in an example of embodiment of the invention.
Figure 13A:
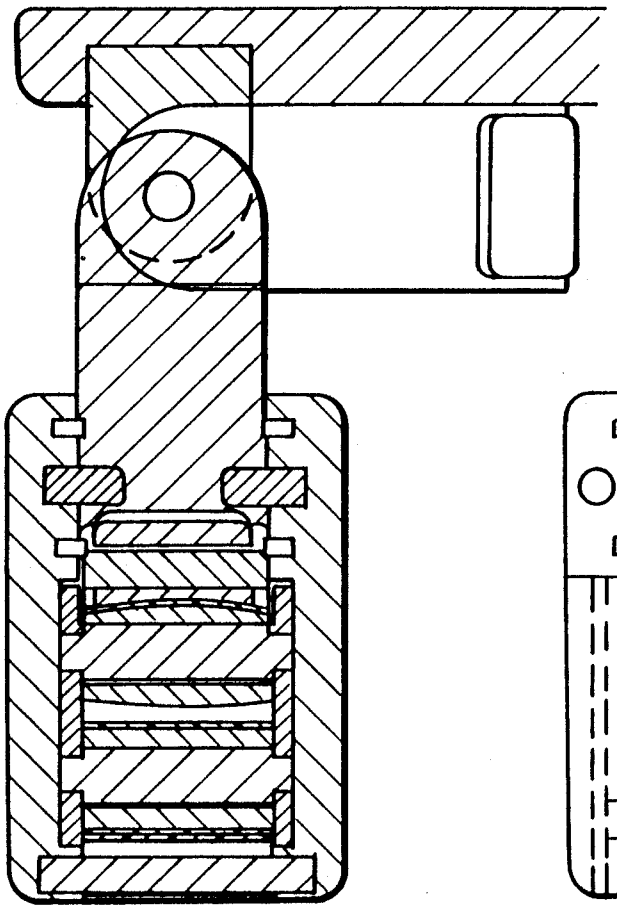

FIGS. 13A and 13B show an example of embodiment of the invention in which a change of the tension of the band 5 is possible via a fishplate 22 which is formed at the band end and lockable on the frame.

Figure 14B:
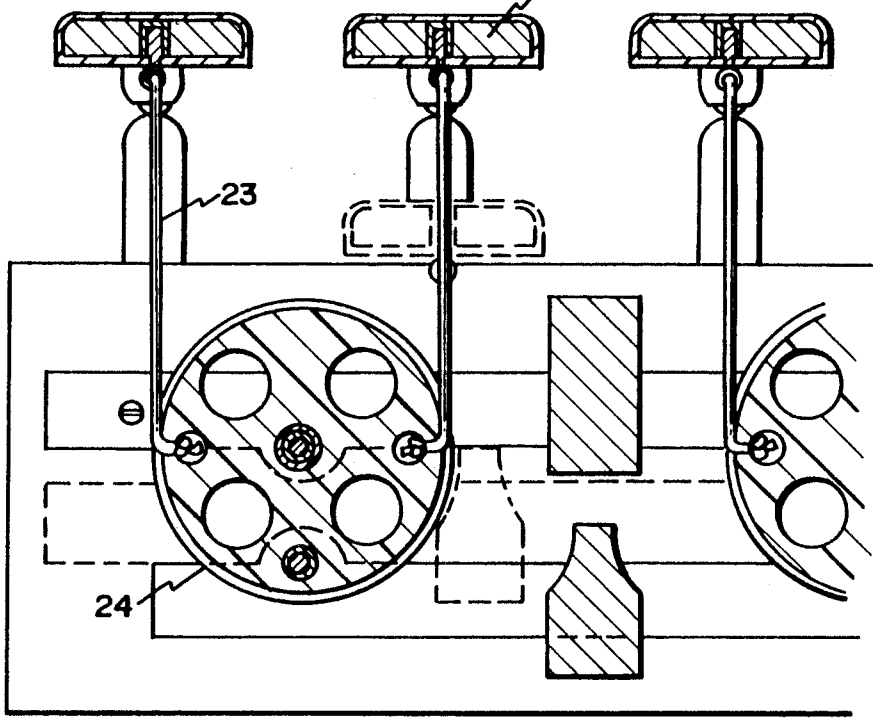
FIGS. 14A–14C are views of a preferred further development of the invention.
Figure 14A:
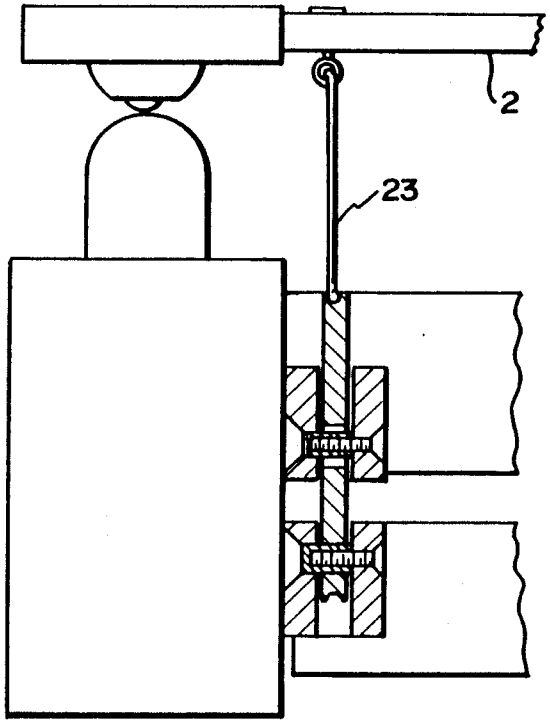
Figure 14C:
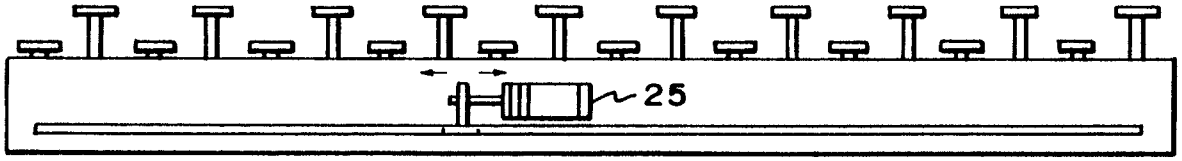

If for example every other lath is to be arrested in the fully sprung-in position and the spring action of the remaining laths thereby made harder, the arrangement illustrated in FIGS. 14A–14C can be used in which at the end region of each lath 2 a flexible tension means, for example a wire cable 23, is disposed which is secured to the outer periphery of a disc element 24 which can be selectively rotated via an actuating means 25. By rotating the disc 24 it is possible in each case to arrest one of the two laths 2 connected to the disc in the lowered position whilst the other lath can freely execute its spring movement. The rotation of the adjusting disc 24 is effected preferably again via a thrust rod which is directly connected to the adjusting means 25 and to which the disc 24 is articulately connected via a pin.

Figure 15:
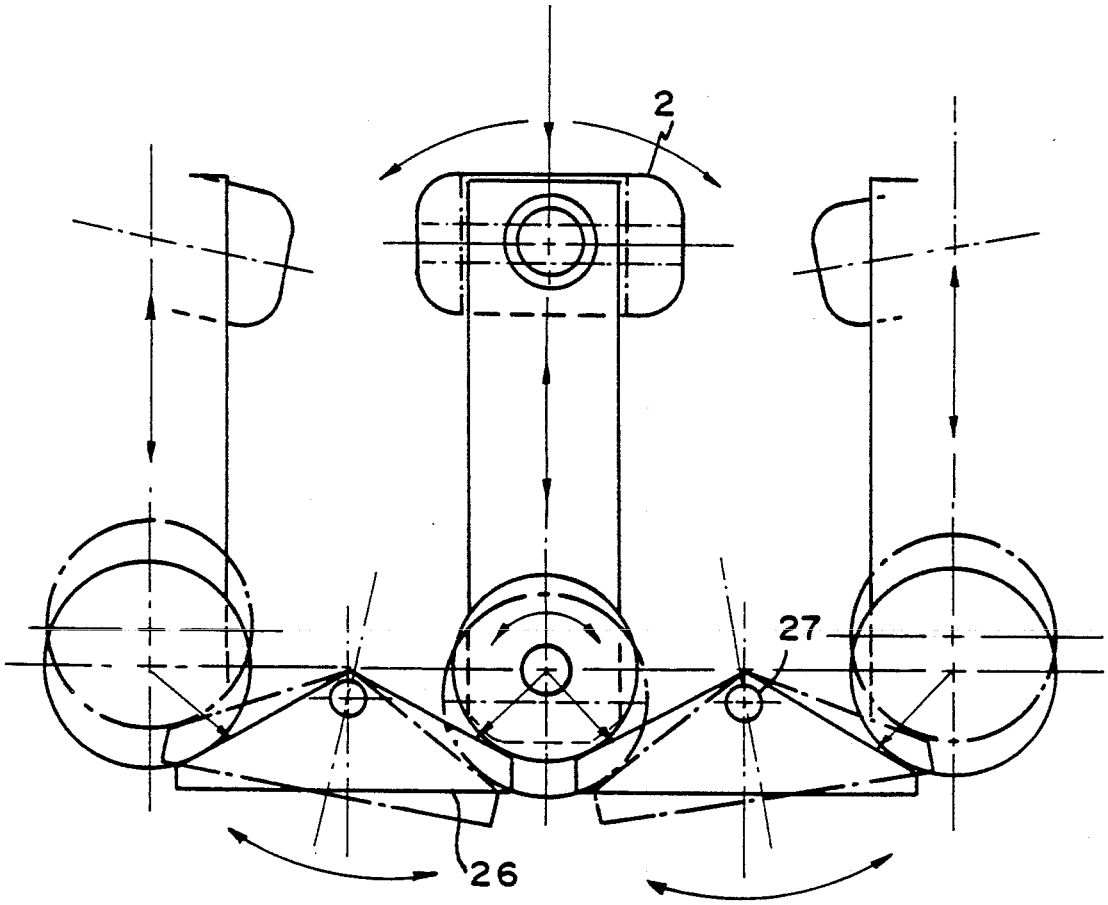
FIG. 15 shows a further example of embodiment of the invention.

FIG. 15 shows a further example of embodiment of the invention in which in contrast to the preceding examples of embodiment no elastic band is provided, the laths 2 being supported instead on triangular components 26 which are mounted pivotally about their apex 27 on the frame. Between every two laths there is a triangular component 26. In this construction the two triangular components 26 arranged at the frame end are fixedly disposed whilst the other rotatably arranged components 26 have a composite effect in which the force exerted by a lath via the support side face of the associated triangular component 26 is transmitted correspondingly via the other side face to the adjacent lath 2, etc. In this manner the same effect as achievable with a continuous elastic band can be attained. In the example of embodiment illustrated in FIG. 15 the laths 2 can once again be supported via rams or push members or directly on the side faces of the triangular components 26.

Figure 16:
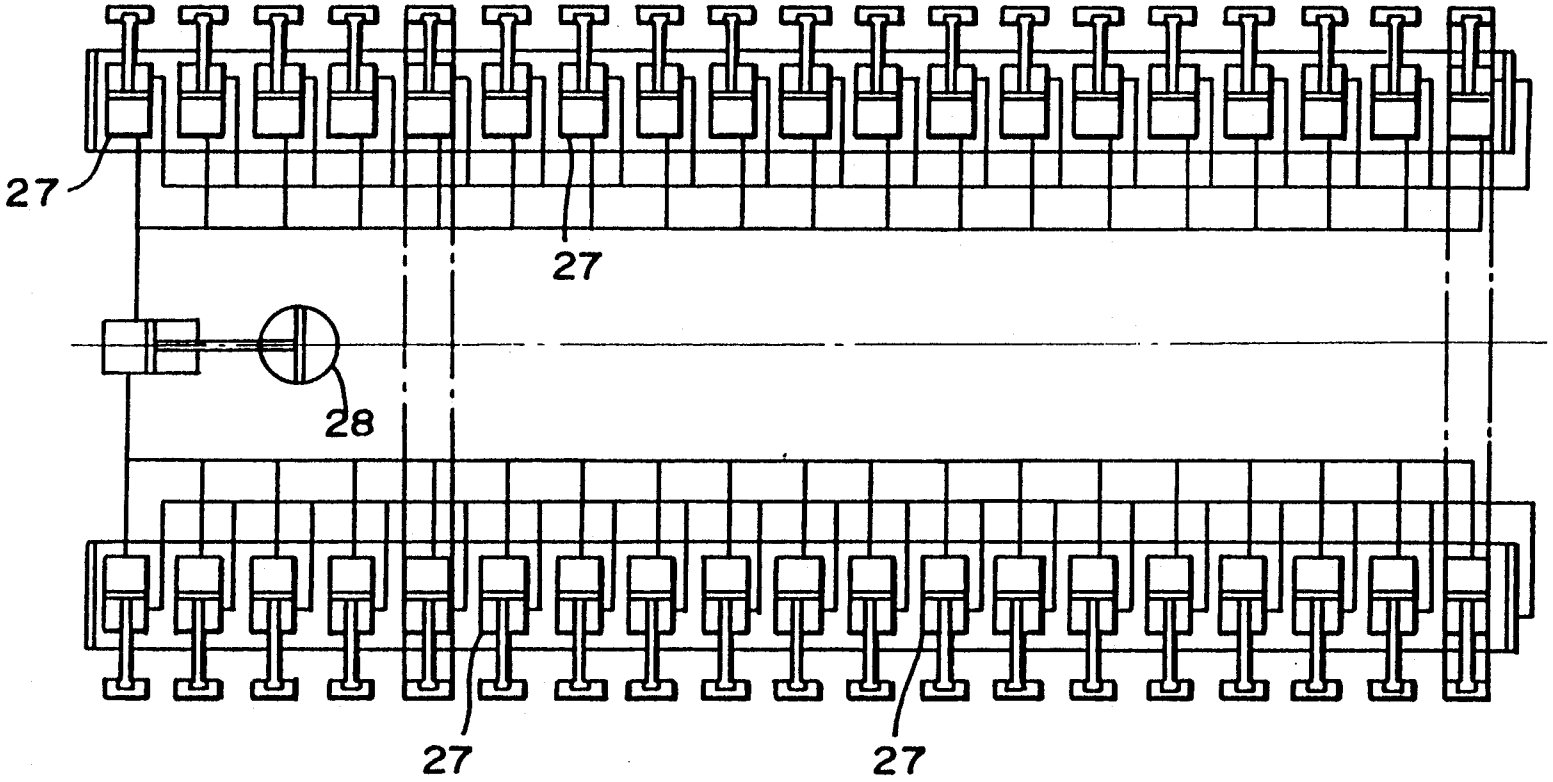
FIGS. 16 and 17 show in schematic diagrams a pneumatic example of embodiment of the undermattress according to the invention.
Figure 17:
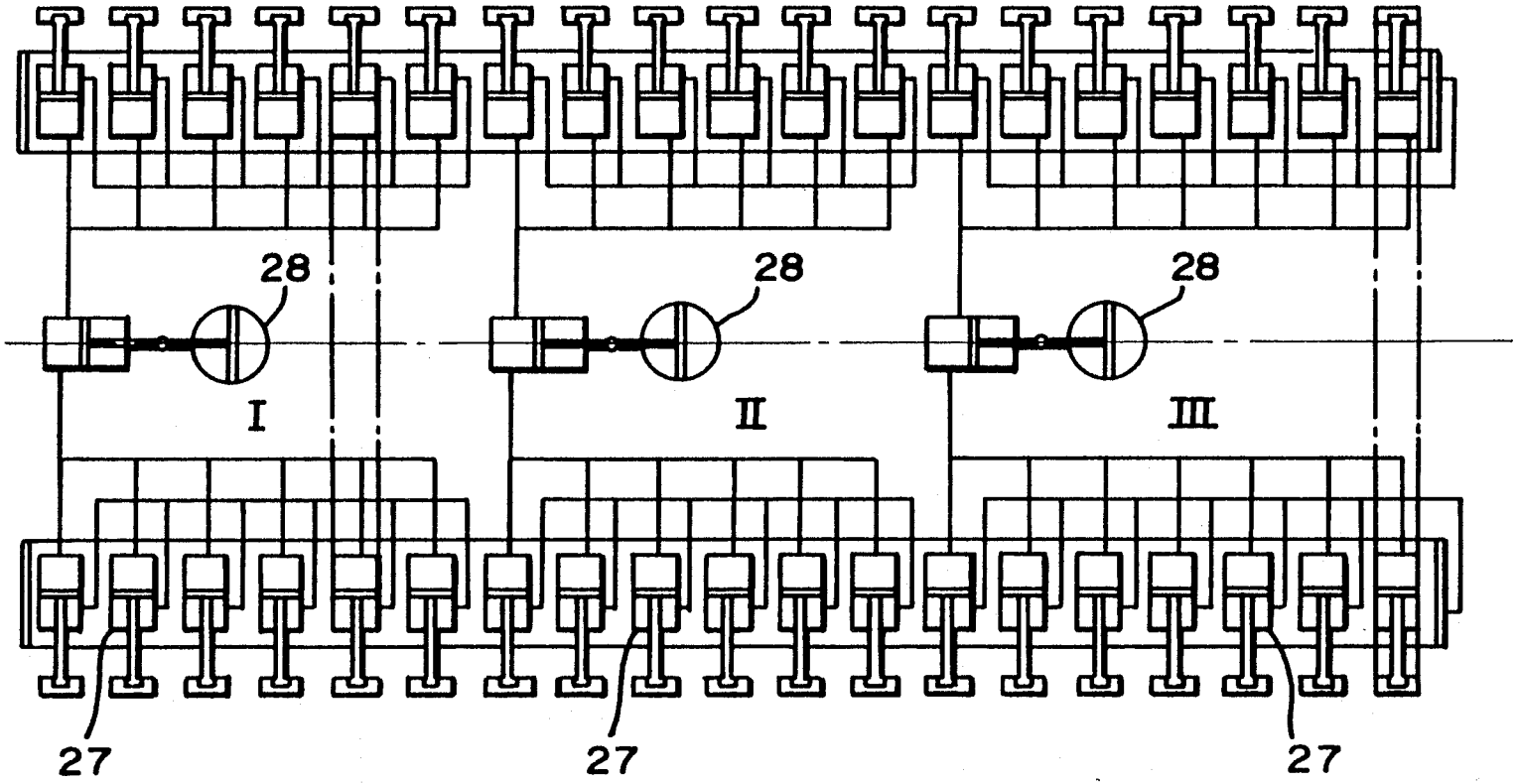

FIGS. 16 and 17 show a pneumatic embodiment of the undermattress according to the invention in which the support means are formed by piston-cylinder means 27, one of which is provided for each lath end. The piston-cylinder means 27 are pneumatically connected with each other so that once again the load exerted by a lath on one piston-cylinder means 27 can be transmitted to the other piston-cylinder means in order to effect a change of the counter pressure obtaining there.

As shown in FIG. 16 a biasing of the arrangement may be effected by means of a pressure compensation regulator 28 which represents a setting means in which the pressure can be mechanically set by means of a scale.

The elastic support means, i e. the band 5, the interconnected triangular components 26 or the intercommunicating piston-cylinder means 27 need not be provided in the form of a single continuous arrangement over the entire frame; they may also be arranged sectionwise independently of each other so that in the longitudinal direction of the mattress the pressure and tension may be preset in variable manner in sections. FIG. 17 shows an example of a pneumatic construction in which the undermattress is divided into three sections I, II, and III in which the piston-cylinder means respectively communicate with each other and are provided with separate pressure composition regulators 28 for presetting the biasing.

Figure 18:
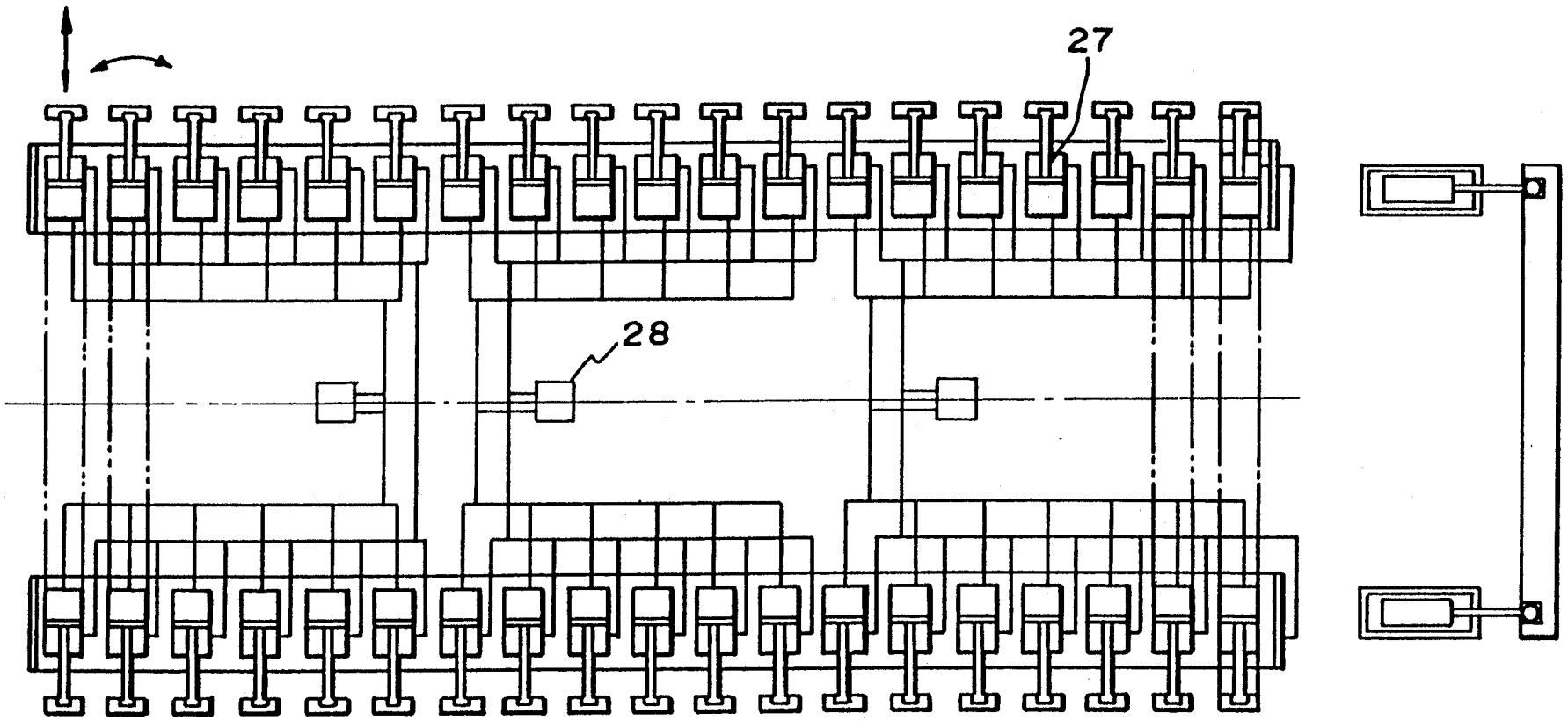
FIG. 18 shows a particularly preferred further development of the example of embodiment illustrated in FIGS. 16 and 17.

In the pneumatic system illustrated in FIG. 18 for setting the pressure equalization a plurality of piston-cylinder means 27 are arranged in closed groups. Said groups serve for example to equalize the pressure over the entire mattress length, to equalize the pressure in two groups or to equalize the pressure in three groups. The pressure equalization system of the individual piston-cylinder means 27 operates via a fluid or gas pressure equalization or by means of another pressure compensating medium.

In the example of embodiment illustrated in FIG. 18 a basic pressure may be set which can be adapted to the body weight of the respective person In addition, via two or three piston-cylinder arrangements arranged independently of each other the basic pressure may be varied simultaneously by means of an electromechanical cylinder provided for that purpose per arrangement.

The adjustment of the pressure is via a keyboard which can be operated from the bed with an extension cable. The operation is such that the bed can be inclined over its entire length, i.e. the longitudinal axis can be raised on one side and lowered on the other side. This makes it possible for patients or elderly persons to get out of the bed more easily and the force which they need for supporting their arms is transmitted fully to the bed. The bed forms an inclination and has at the same time a stabilizing effect so that less force is required to get up. This possibility of inclined positioning further facilitates changing linen in hospital beds. In such a change of the linen the patient is turned to one side, one half of the bed covered with the sheet and thereafter the patient turned onto the other side to pull the sheet over the entire bed. By the facility of inclining the bed the patient can be more easily turned onto one side.

Figure 19:
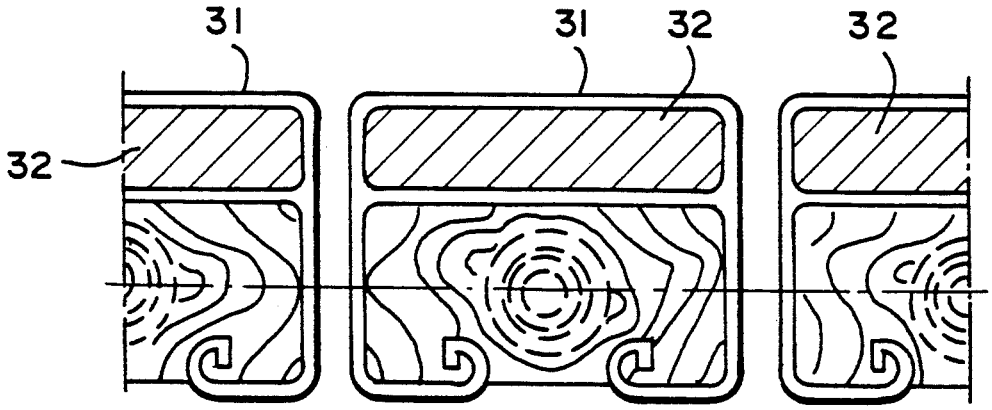
FIG. 19 shows in sectional view a particularly preferred further development of the undermattress according to the invention.

In the example of embodiment of the undermattress illustrated in FIG. 19 the transverse laths of wood can be provided with an additional liquid equalization which can be used in stabilizing and pulsating manner.

For this purpose, the transverse slats consisting of wood can be covered with a plastic member 31 consisting of several shore hardnesses, the upper side being formed as hollow body 32 which is filled with a pressure medium. This construction can produce the effect of a water bed.

The hollow bodies 32 can be filled with air or a liquid.

Figure 20:
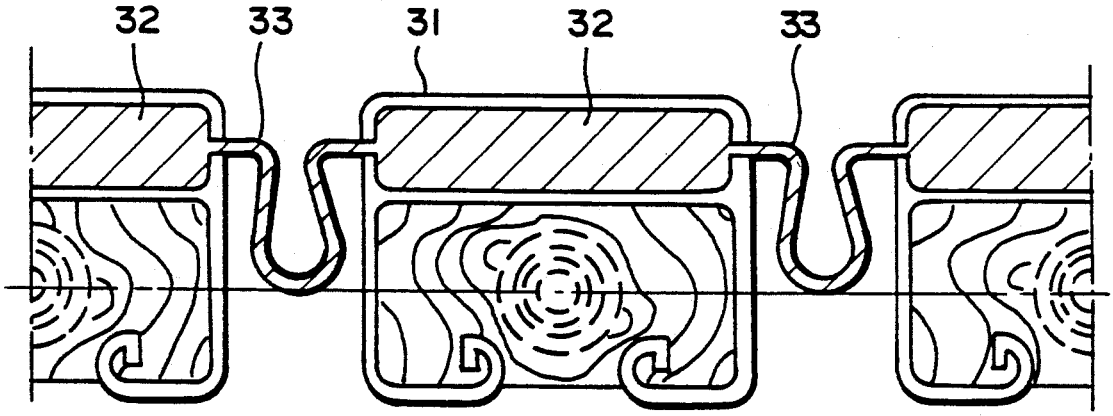
FIG. 20 shows in sectional view a further development of the example of embodiment illustrated in FIG. 19, FIGS. 21A and 21B show side and plan views of another preferred further development of the undermattress according to the invention

As is apparent in FIG. 20, preferably the hollow bodies 32 are connected together via connecting hoses 33 from transverse lath to transverse lath so that a variably adjustable support results which can replace a mattress.

This construction is expedient in particular for hospital beds for patients with burns, spinal complaints or slipped discs, for therapy of the back and in persons bedridden for long periods of time.

Due to the connection by means of the hoses 33 it is possible to subject the fluid to different pressures which can be freely selected by the personnel or patient. The pressure setting can for example be effected by an electromechanical cylinder. At the same time the fluid can be sent in pulsating manner through the individual hollow bodies 32. This gives a vibratory effect which can be applied for various illnesses or simply to relax the body.

The connection of the individual hollow bodies 32 may be chosen in such a manner that similarly to a structure with one-part, two-part or three-part pressure loading the massage effect can be achieved over the entire body or over individual parts of the body in groups, for example in the pelvic region, in the trunk region and in the shoulder and head region.

In the example of embodiment illustrated in FIGS. 19 and 20 the conventional mattress on the laths or battens is superfluous and consequently this example of embodiment can obviously be covered directly with an ordinary stretched sheet.

Figure 21A:
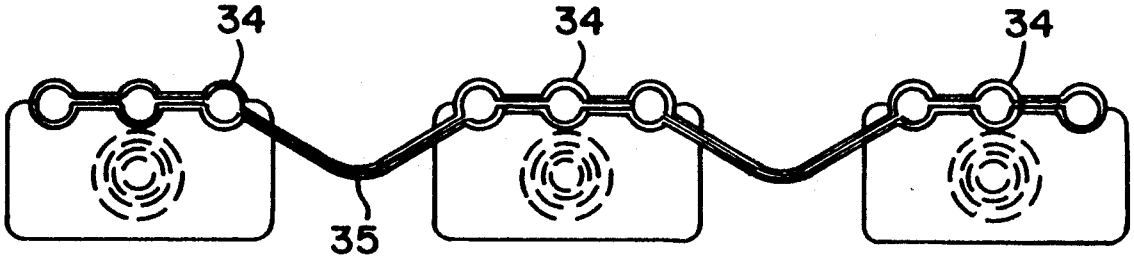
Figure 21B:
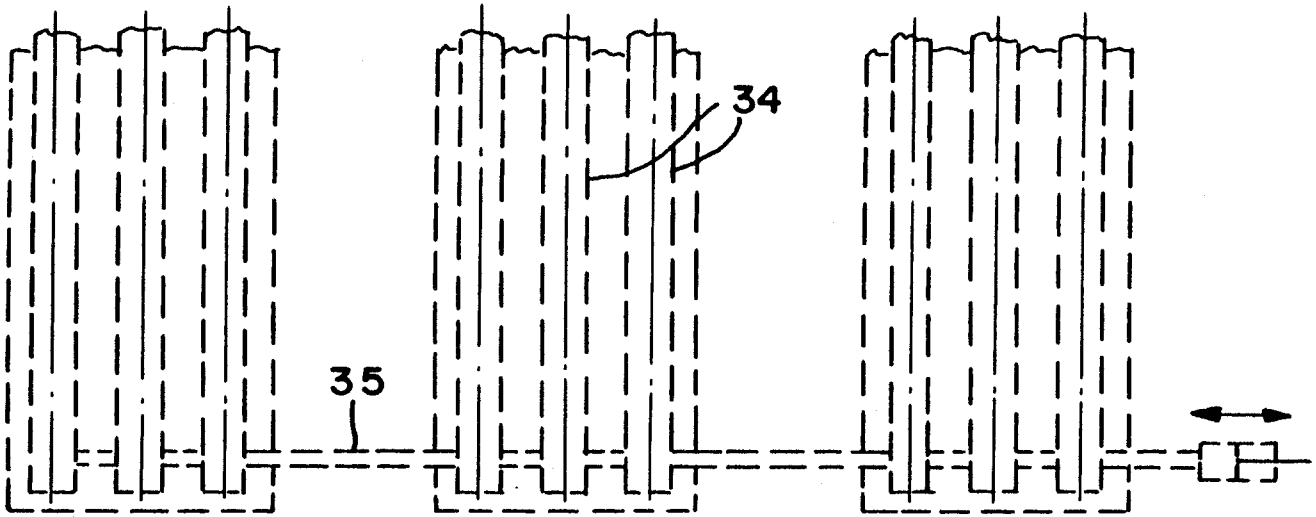

In the example of embodiment illustrated in FIG. 21 the laths are provided with one to three transverse hoses or flexible tubes 34 which are again coupled to each other by connecting conduits 35. This construction fulfils the same function as in the example of embodiment illustrated in FIGS. 19 and 20, it being possible to more finely adjust the pressure effect so that the construction illustrated in FIGS. 21A and 21B is generally applicable for pure massaging.

Figure 22B:
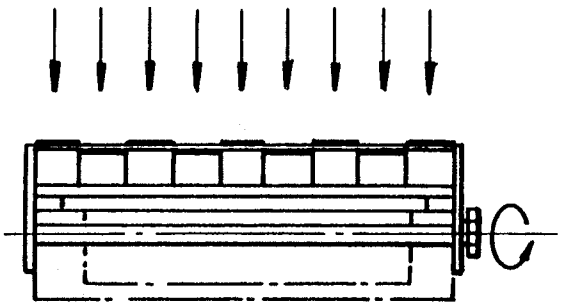
FIGS. 22A–22C show side elevation, end elevation and partially broken away plane view of a further example of embodiment of the undermattress according to the invention.
Figure 22A:
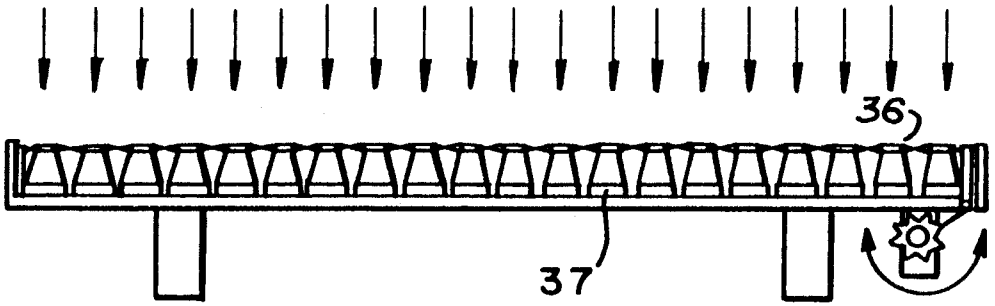
Figure 22C:
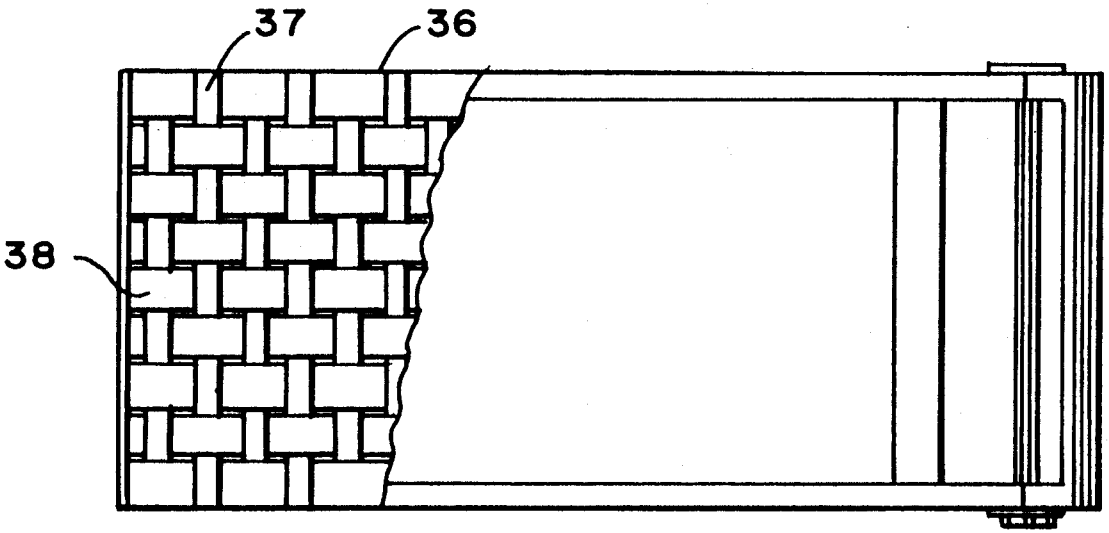

Finally, FIGS. 22A–22C show an example of embodiment of the invention which consists of a foamed rubber structure of varying hardness of foamed rubber wedges 37 which replace the transverse laths and are braced in the longitudinal direction with rubber-like elastic belts 38.

The weight adjustment corresponding to the body weight is effected via the longitudinally tensioned belts 38 by means of a tensioning pulley 40.

Over the transversely extending foamed rubber wedges 37 additional hard fibre strips are tensioned which are connected in the manner of a plaiting to the longitudinal belts 38. The longitudinal belts are made from a rubber-elastic material which is fabric-supported.

In the construction illustrated in FIGS. 22A–22C the weight equalization is by the belts 38 tensioned in the longitudinal direction. The punctiform loading is taken up by the transversely extending foamed rubber wedges 37 and by the tensioning means the loading can be selected so that the transversely extending foamed rubber wedges 37 act more in the form of a punctiform pressure support or with higher tensioning of the longitudinal belts 38 a greater weight compensation is effected in the longitudinal direction and the punctiform loading is reduced.

The example of embodiment illustrated in FIGS. 22A–22C is particularly suitable for children's beds or beds for young persons. Tests have shown that the construction illustrated in FIG. 22 is particularly suitable for children and young persons already suffering from incipient abnormalities in posture.

We claim:

1. Undermattress comprising a frame which is spanned in a transverse direction by a plurality of laths which are supported on the frame at each end by a respective joint and by a yieldable means for supporting said laths in conjunction with said joints so as to be yieldable in a direction of loading of the undermattress, wherein each joint is formed from a joint pin having a rounded joint head and a guide bush, each joint head being fitted into a respective guide bush, without engaging an opposite side thereof, and being shaped for enabling movement of the joint pin relative to the guide bush in every direction.

2. Undermattress according to claim 1, wherein each joint pin is mounted to a respective lath end and the guide bush bears on the yieldable means.

3. Undermattress according to claim 1, wherein the guide bush is in the form of a hollow cylindrical element having an internal diameter which corresponds to an outer diameter of the joint head with a slight clearance therebetween.

4. Undermattress according to claim 3, wherein the yieldable means is elastically springy.

5. Undermattress according to claim 4, wherein the elastically springy yieldable means comprises an elastic band which is guided via rollers which are rotatable about a stationary position on the frame and are disposed at least as a pair of roller flanking each of the engagement points on which the joints bear on the elastic band.

6. Undermattress according to claim 5, wherein each of the hollow cylindrical guide bushes of the joints lies on a band portion between pairs of said rollers.

7. Undermattress according to claim 5, wherein ends of the lath rest via push members on the band and are connected thereto via the respective joints.

8. Undermattress according to claim 5, wherein the band is guided in a loop about a further roller before it runs over from a roller of the pair of rollers flanking one engagement point to an adjacent roller of the pair of rollers flanking an adjacent engagement point.

9. Undermattress according to claim 5, wherein the band is an endless band and has a pair of webs which run linearly over the rollers.

10. Undermattress according to claim 9, wherein both the webs of the endless band contact the rollers.

11. Undermattress according to claim 10, wherein a web of the band which is more remote from the lath engagement points that the other bears on an inflatable or extendable hose which is laid along the frame.

12. Undermattress according to claim 5, wherein an end of a web of the band is withdrawably connected to a pawl device while an opposite end of the web runs through a holding means for blocking a return run.

13. Undermattress according to claim 7, wherein ends of every two adjacent laths are adjustably connected to the outer periphery of an adjusting disc which is arranged so as to be selectively rotatably from the outside.

14. Undermattress according to claim 7, wherein angle levers which are pivoted in their centre about a pin on the frame and are held at one end via a further pin on a thrust rod which actuatable, the angle levers being arranged in such a manner that in one position of the thrust rod their other ends support the laths.

15. Undermattress according to claim 1, wherein the yieldable means comprises triangular components which are held between the ends of two laths so as to be pivotal about their apices on the frame, side faces of the triangular components forming support faces for the ends of the laths and wherein the triangular components mounted at the ends of frame are fixedly arranged.

16. Undermattress according to claim 1, wherein a plurality of independent yieldable means are provided in sections along the frame.

17. Undermattress according to claim 6, wherein a plurality of independent yieldable means are provided in sections along the frame, and wherein the rollers are multiply grooved and multiply surrounded in sections by several said bands, the number of the surrounding bands being selected in dependence upon the load to be expected.

18. Undermattress according to claim 1, wherein the yieldable means comprises interconnected piston-cylinder means for each lath end on which a respective lath end is supported.

19. Undermattress according to claim 18, wherein the piston-cylinder means are connected to each other in sections.

20. Undermattress according to claim 19, wherein the piston-cylinder means are provided with a pressure setting means for setting the basic pressure.

21. Undermattress according to claim 19, wherein a pressure setting means is provided for each section of the piston-cylinder means.

22. Undermattress according to claim 1, wherein comprises a flexible tube or hose which is filled with a pressure transfer medium and which is provided with a pressure equalizing nipple for setting the internal pressure of the tube or hose.

23. Undermattress according to claim 1, wherein the laths are covered with a plastic member which is formed as a hollow body at an upper side.

24. Undermattress according to claim 23, wherein the hollow bodies are connected together by hoses.

25. Undermattress according to claim 24, wherein the hollow bodies are filled with a medium, the pressure of which is adjustable.

26. Undermattress according to claim 1, wherein cross hoses are arranged at the upper side of the laths, transversely of the frame, and wherein the cross hoses are connected together via connecting conduits and are filled with a medium of which the pressure is adjustable.

* * * * *